US011976444B2

(12) United States Patent
Kurth et al.

(10) Patent No.: US 11,976,444 B2
(45) Date of Patent: May 7, 2024

(54) WORK MACHINE WITH GRADE CONTROL USING EXTERNAL FIELD OF VIEW SYSTEM AND METHOD

(71) Applicant: Deere & Company, Moline, IL (US)

(72) Inventors: Luke J. Kurth, Asbury, IA (US); Sean A. Mairet, Dubuque, IA (US); Billy J. Naderman, Dubuque, IA (US)

(73) Assignee: Deere & Company, Moline, IL (US)

( * ) Notice: Subject to any disclaimer, the term of this patent is extended or adjusted under 35 U.S.C. 154(b) by 283 days.

(21) Appl. No.: 17/541,484

(22) Filed: Dec. 3, 2021

(65) Prior Publication Data

US 2023/0175236 A1 Jun. 8, 2023

(51) Int. Cl.

| | |
|---|---|
| ***E02F 9/26*** | (2006.01) |
| ***E02F 3/76*** | (2006.01) |
| ***E02F 3/84*** | (2006.01) |
| ***E02F 9/20*** | (2006.01) |

(52) U.S. Cl.

CPC ..... *E02F 9/262* (2013.01); *E02F 3/7636* (2013.01); *E02F 3/841* (2013.01); *E02F 3/844* (2013.01); *E02F 9/2041* (2013.01); *E02F 9/265* (2013.01)

(58) Field of Classification Search

CPC ... E02F 9/265; E02F 9/264; E02F 3/16; E02F 9/262; E02F 3/7609; E02F 9/20; E02F 3/845; E02F 9/2004; G06T 7/73

See application file for complete search history.

(56) References Cited

U.S. PATENT DOCUMENTS

| | | | | |
|---|---|---|---|---|
| 5,559,725 A * | 9/1996 | Nielson | E02F 3/16 701/50 |
| 9,328,479 B1 | 5/2016 | Rausch et al. | |
| 9,904,290 B2 | 2/2018 | Pickett et al. | |
| 10,030,358 B2 | 7/2018 | Wallace et al. | |
| 10,066,367 B1 * | 9/2018 | Wang | E02F 9/262 |

(Continued)

FOREIGN PATENT DOCUMENTS

| | | | |
|---|---|---|---|
| CN | 106460360 A * | 2/2017 | E02F 3/32 |
| CN | 105229423 B * | 3/2019 | E02F 3/845 |

(Continued)

*Primary Examiner* — Yuri Kan

(74) *Attorney, Agent, or Firm* — Gary L. Montle; Lucian Wayne Beavers; Patterson Intellectual Property Law, PC

(57) ABSTRACT

A work machine is provided with grade control capability using an imaging system, e.g., rather than GPS. The work machine includes at least one work implement for working at least part of a terrain, and first sensors (e.g., cylinder sensors) generate signals corresponding to positions of the work implement. Second sensors (e.g., stereo cameras) generate signals corresponding to positions of representative features of the terrain (e.g., curbs) in a field of view. A controller receives the signals and determines in a local reference system independent of a global reference system: first position information corresponding to the work implement; and second position information corresponding to the representative features. According to a selected control mode, target parameters for the work implement are determined based on the second position information corresponding to the representative features, and output signals are generated corresponding to a difference between the first position information and the target parameters.

18 Claims, 5 Drawing Sheets

(56) References Cited

U.S. PATENT DOCUMENTS

| | | | | |
|---|---|---|---|---|
| 10,526,766 | B2 | 1/2020 | Hageman et al. | |
| 10,634,492 | B2 | 4/2020 | Beery et al. | |
| 10,883,248 | B2 | 1/2021 | Stotlar | |
| 10,952,021 | B2 | 3/2021 | Kean et al. | |
| 10,975,547 | B2 | 4/2021 | Mahrenholz | |
| 11,124,943 | B2 | 9/2021 | Kean et al. | |
| 11,230,824 | B2 * | 1/2022 | Narikawa | E02F 9/262 |
| 11,459,733 | B2 * | 10/2022 | Hashimoto | E02F 3/7609 |
| 2011/0169949 | A1 | 7/2011 | Mccain et al. | |
| 2014/0300732 | A1 * | 10/2014 | Friend | G06T 7/73 348/135 |
| 2018/0061040 | A1 | 3/2018 | Beery et al. | |
| 2019/0032305 | A1 | 1/2019 | Hageman et al. | |
| 2020/0040550 | A1 * | 2/2020 | Davis | E02F 9/264 |
| 2020/0087887 | A1 | 3/2020 | Kean et al. | |
| 2020/0087888 | A1 | 3/2020 | Kean et al. | |
| 2022/0049457 | A1 * | 2/2022 | Harada | E02F 9/262 |

FOREIGN PATENT DOCUMENTS

| | | | | |
|---|---|---|---|---|
| DE | 102018207706 | A1 | 3/2019 | |
| DE | 102019211708 | A1 | 2/2020 | |
| DE | 102020206190 | A1 | 11/2020 | |
| DE | 102020207978 | A1 | 2/2021 | |
| DE | 102021204257 | A1 | 11/2021 | |
| EP | 3290592 | A1 | 3/2018 | |
| JP | 2009121127 | A * | 6/2009 | E02F 9/20 |

* cited by examiner

WORK MACHINE WITH GRADE CONTROL USING EXTERNAL FIELD OF VIEW SYSTEM AND METHOD

FIELD OF THE DISCLOSURE

The present disclosure relates generally to work machines such as motor graders having integrated control systems for regulating the working of terrain, and more particularly in various embodiments to systems and methods having control operations integrating external field of view systems.

BACKGROUND

Work machines as discussed herein may generally include any self-propelled vehicles which include work implements for controllably moving, shaping, or otherwise altering elements of a terrain being traversed by the work machine. Motor graders are used herein as the illustrative example of such self-propelled work vehicles, but are not exclusively intended as such unless otherwise specifically stated, and may reasonably include road milling machines, cold planers, pavers, and the like.

Sonic grade control systems are commonly used in the roadbuilding industry to reference a string line, curb, or existing surface in the context of working the proximate terrain. Conventional tools for such grade control systems may be auxiliary in nature, requiring for example masts, cables, and hardware to install on the work machine. Such components may be particularly vulnerable to damage during a working operation and are also typically removed daily to prevent theft.

Other known grade control systems incorporate global positioning systems (GPS) for providing information in a global reference system during operation. However, such information may lack a requisite amount of precision or even be unavailable in some work contexts.

It would therefore be desirable to eliminate the need for a mast and a two-dimensional sonic sensor mounted to the blade or screed of a work machine, and still further to eliminate the reliance on GPS integration for accomplishing the same.

BRIEF SUMMARY

The current disclosure provides an enhancement to conventional systems, at least in part by introducing a novel system and method for grade control using integrated vision (e.g., stereo camera) technology plus onboard inertial measurement units (IMU's) and/or position sensing cylinders.

This technology may for example be applied to multiple attachments and machine forms (e.g., buckets) to follow a set elevation on an established feature (e.g., an existing road surface, curb, or potentially the crown of a road) and for example prevent potential damage to fresh curbs that conventionally require sonic sensors to hover directly over the surface.

The potential elimination of sonic sensors in direct proximity to the curb or equivalent other external feature of the terrain may also allow operators to more readily implement other potential machine features (rotate, pitch, etc.) that may be substantially limited by conventional configurations.

In a first exemplary embodiment, a method as disclosed herein is provided for operating a work machine having a main frame supported by one or more ground engaging units, wherein the work machine travels in a working direction and at a ground speed based at least in part on control of the ground engaging units, and wherein the work machine comprises a work implement supported from the main frame and configured for working at least part of a terrain across which the work machine travels. Signals are received from first sensors (e.g., cylinder sensors) for determining, in a local reference system independent of a global reference system, position information corresponding to the work implement. Signals are further received from second sensors (e.g., stereoscopic cameras) for determining in the local reference system position information corresponding to one or more representative features of the terrain in a field of view for the second sensors. According to a selected control mode, at least one target parameter for the work implement is determined based on the position information corresponding to the one or more representative features, and output signals are generated corresponding to a difference between the position information corresponding to the work implement and the at least one target parameter.

In a second embodiment, one exemplary aspect according to the above-referenced first embodiment may include that the output signals are provided for automatically controlling movement of the work machine and/or a position of the work implement based on the at least one target parameter.

In a third embodiment, one exemplary aspect according to any one of the above-referenced first or second embodiments may further include that movement of the work machine and/or the position of the work implement is controlled further in view of a margin of safety between at least one ground engaging tool of the work implement and the at least one target parameter.

In a fourth embodiment, one exemplary aspect according to any one of the above-referenced first to third embodiments may include that the at least one target parameter is selected from a group consisting of: a target elevation; a target depth; a target slope; a target grade or profile; and a target route or trajectory.

In a fifth embodiment, one exemplary aspect according to any one of the above-referenced first to fourth embodiments may include that the output signals are provided for displaying information corresponding to a position of the work implement on a display unit onboard the work machine and/or a display unit associated with a mobile computing device.

In a sixth embodiment, one exemplary aspect according to any one of the above-referenced first to fifth embodiments may include that sense elements of the received signals from a plurality of the first sensors may be provided for processing in the local reference system by a fusion module.

In a seventh exemplary embodiment, a work machine as disclosed herein includes a main frame supported by one or more ground engaging units, wherein the work machine travels in a working direction and at a ground speed based at least in part on control of the ground engaging units, and a work implement supported from the main frame and configured for working at least part of a terrain across which the work machine travels. One or more first sensors are configured to generate signals corresponding to positions of the work implement, and one or more second sensors having a field of view associated at least in part with the working direction are configured to generate signals corresponding to positions of one or more representative features of the terrain in the field of view. A controller is functionally linked to the one or more first sensors, the one or more second sensors, and at least one actuator associated with controlled movement of the work implement relative to the terrain. The controller may be configured to direct the performance of operations in a method according to any one of the above-referenced first to sixth embodiments.

In one exemplary aspect according to at least the above-referenced seventh embodiment, at least one of the first sensors may be located on the main frame and at least one of the first sensors may be located in association with a position of the work implement relative to the main frame. For example, the at least one of the first sensors located in association with a position of the work implement relative to the main frame may comprise a plurality of sensors located in association with respective hydraulic piston-cylinder units for positioning of the work implement relative to the main frame. The at least one of the first sensors located in association with a position of the work implement relative to the main frame may further or in the alternative comprise at least one sensor having a field of view comprising at least a portion of the work implement. The at least one of the first sensors located in association with a position of the work implement relative to the main frame may still further or in the alternative comprise a least one radio frequency transmitter.

In another exemplary aspect according to at least the above-referenced seventh embodiment, at least one of the first sensors is located on the main frame and at least one of the first sensors is located in association with a position of the work implement relative to the terrain. For example, the at least one of the first sensors located in association with a position of the work implement relative to the terrain may comprise a plurality of sensors located in association with respective hydraulic piston-cylinder units for positioning of the work implement relative to a ground surface.

In another exemplary aspect according to at least the above-referenced seventh embodiment, different ones of the plurality of first sensors may be located on respective components of the work implement between the main frame and a ground engaging tool.

Numerous objects, features and advantages of the embodiments set forth herein will be readily apparent to those skilled in the art upon reading of the following disclosure when taken in conjunction with the accompanying drawings.

DETAILED DESCRIPTION

Referring now to FIGS. 1-5, various embodiments may now be described of a system and method for a work machine including a grade control system implementing, e.g., imaging technology in a local reference system in place of conventional global positioning technology.

Figure 1:
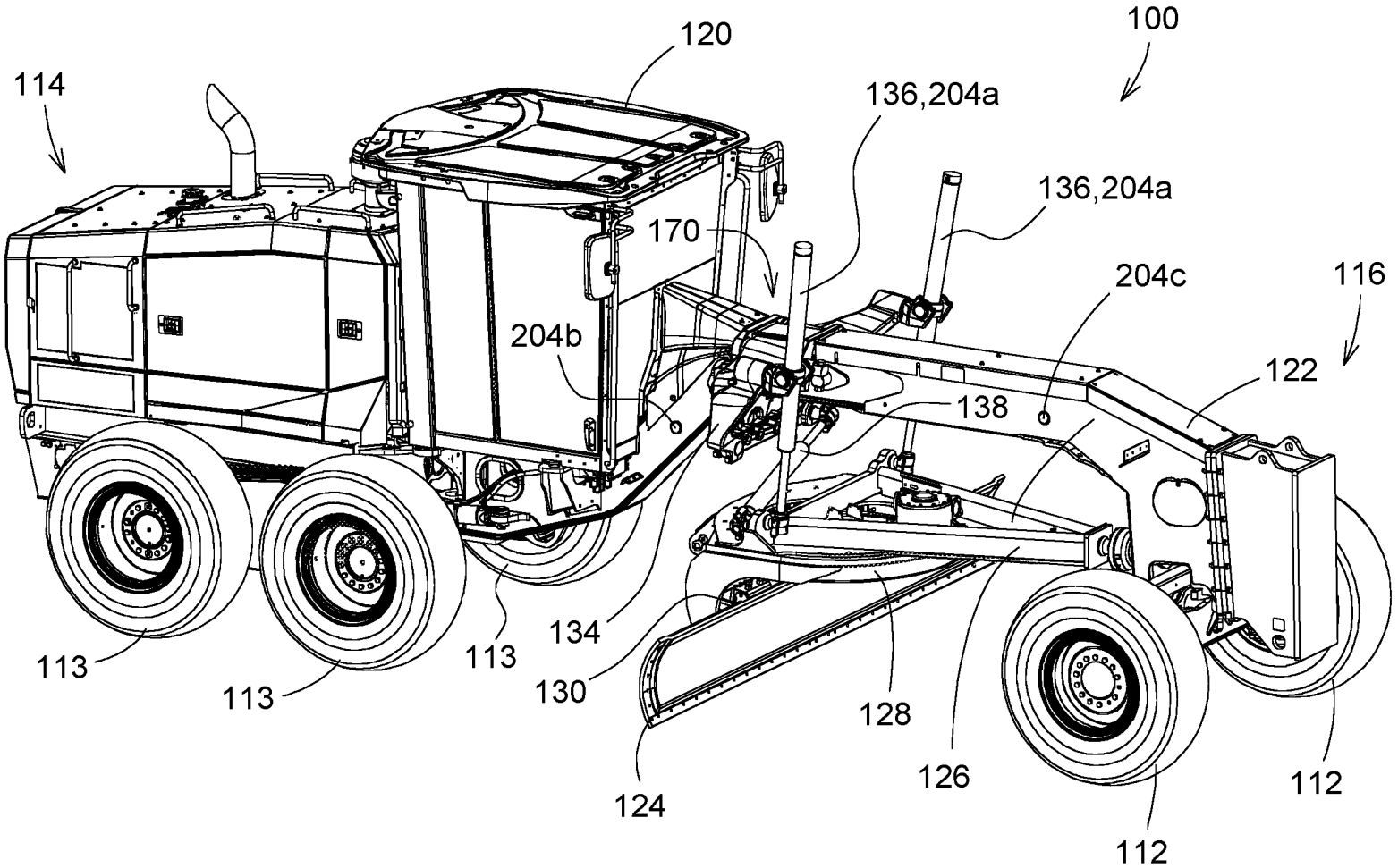
FIG. 1 is a perspective view of a motor grader as an exemplary work machine according to an embodiment as disclosed herein.
Figure 2:
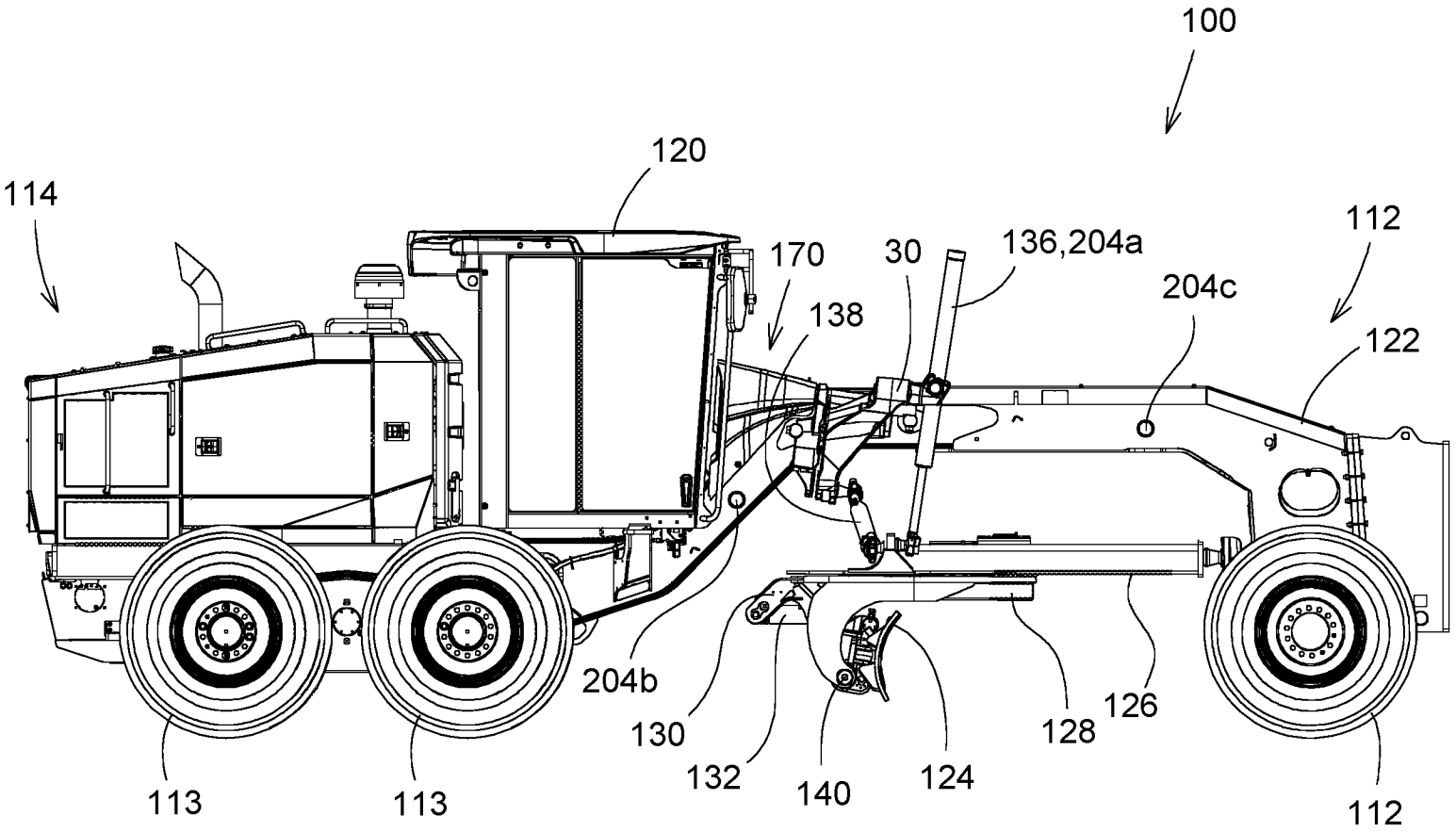
FIG. 2 is a side view of the motor grader of FIG. 1.
Figure 3:
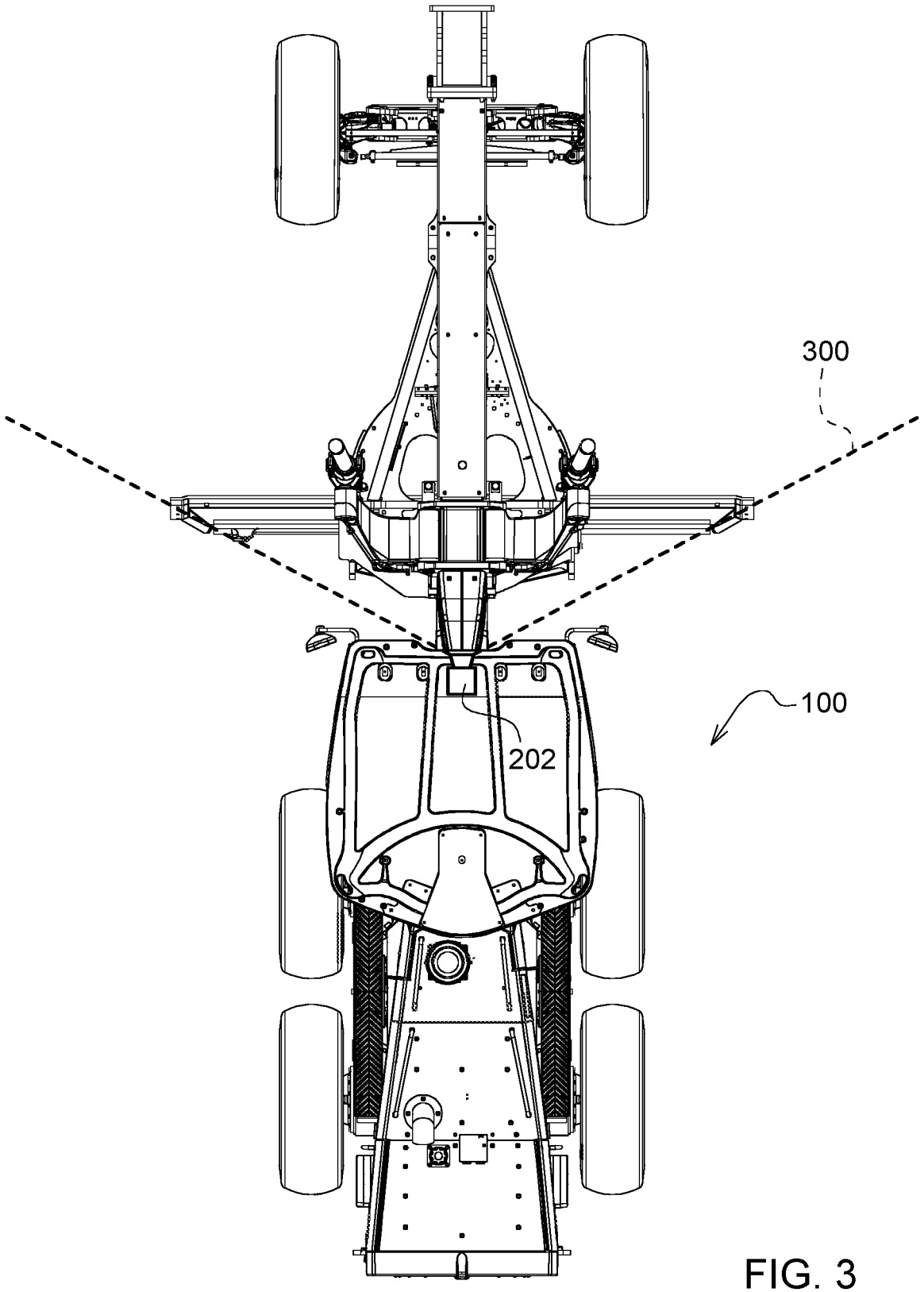
FIG. 3 is an overhead view of the motor grader of FIG. 1 including an exemplary field of view sensor.

FIGS. 1-3 in a particular embodiment as disclosed herein show a representative work vehicle 100 in the form of, for example, a motor grader 100 which has two front traction wheels 112 and four rear traction wheels 113. It should be understood that the illustrated motor grader 100 is provided as an example and embodiments described herein may be used with other work vehicles 100 that differ from the motor grader 100 illustrated in FIGS. 1-3.

The work vehicle 100 has rear and front portions 114, 116, respectively. An engine frame 121 of the rear portion 114 and a main frame 122 of the front portion 116 are articulated to one another at an articulation joint 170 for steering of the self-propelled work vehicle 100 left and right using respective articulation cylinders (not shown) that are coupled to and extending between the rear and front portions 114, 116. As used herein, terms such as "left" and "right" may generally be considered relative to a central fore-aft axis of the work vehicle 100.

The rear portion 114 includes an internal combustion engine (e.g., diesel engine) to power the work vehicle 100 and a tandem on each side of the vehicle 100, only the left tandem being illustrated. Each tandem has two traction wheels 113 that may be driven by the engine of the work vehicle 100 through a transmission for propulsion of the work vehicle 100, each tandem having a chain drive with two chains each between a tandem axle and a respective wheel 113. The rear portion 114 thus has four of the six traction wheels of the self-propelled work vehicle 100, two on the left with one in front of the other and two on the right with one in front of the other.

The front portion 116 has an operator's station 120 from which a human operator can control various operations of the work vehicle 100. The operator's station 120 may include a user interface 230 (not shown in FIG. 1 but represented as part of the control system 200 in FIG. 4). The term "user interface" 230 as used herein may broadly take the form of a display unit and/or other outputs from the system such as indicator lights, audible alerts, and the like. The user interface may further or alternatively include various controls or user inputs (e.g., a steering wheel, joysticks, levers, buttons) for operating the work vehicle 100, including operation of the engine, hydraulic cylinders, and the like. Such an onboard user interface may be coupled to a vehicle control system via for example a CAN bus arrangement or other equivalent forms of electrical and/or electro-mechanical signal transmission. Another form of user interface (not shown) may take the form of a display that is generated on a remote (i.e., not onboard) computing device, which may display outputs such as status indications and/or otherwise enable user interaction such as the providing of inputs to the system. In the context of a remote user interface, data transmission between for example the vehicle control system and the user interface may take the form of a wireless communications system and associated components as are conventionally known in the art.

The front portion 116 of the work vehicle 100 supports a work implement 124, which in the shown embodiment of FIG. 1 takes the form of a moldboard 124, mounted to the main frame 122 of the front portion 116. The moldboard 124 is configured for moving earthen or other material, e.g., to create a desired contour of the ground surface, and may be mounted for movement in a number of directions, including translational movement, roll, pitch, and yaw. A draft frame 126 is coupled to the main frame 122 toward the front via a ball-and-socket joint. A circle frame 128 is coupled to the draft frame 126 to rotate relative thereto by use of a circle drive 129 mounted to the draft frame 126. A tilt frame 130 holds the moldboard 124 and is coupled pivotally to the circle frame 128 for pivotal movement of the tilt frame 130 and the moldboard 124 held thereby relative to the circle frame 128 about a tilt axis by use of a tilt cylinder 132. The tilt cylinder 132 is connected to the circle frame 128 and the tilt frame 130 there between to change the pitch of the tilt frame 130, and thus the moldboard 124, relative to the circle frame 128. The moldboard 124 is coupled to the circle frame 128 through the tilt frame 130 to rotate with the circle frame 128 relative to the draft frame 126.

A saddle 134 is mounted to the main frame 122. Left and right lift cylinders 136 (only the left lift cylinder is shown) are connected to the saddle 134 and the draft frame 126 there between as hydraulic actuators for raising and lowering the sides of the draft frame 126, and thus the moldboard 124, relative to the main frame 122. For example, the left and right lift cylinders 136 can raise and lower the draft frame 126 (i.e., in a generally vertical direction relative to the ground) by raising or lowering both the sides of the draft frame 126. Additionally, the left and right lift cylinders 136 can pivot (i.e., roll) the draft frame 126 by raising or lowering one side of the draft frame 126 relative to the other side. The left and right lift cylinders 136 may be used to adjust the roll of the moldboard 124 in order to align the moldboard 124 with the cross slope of the ground surface. The cross slope angle is the angle of the surface measured in the direction that is perpendicular to the direction the work machine 100 is traveling and relative to gravity.

The left and right lift cylinders 136 raise and lower the draft frame 126 by moving along a stroke path from an extended position to a retracted position to adjust the length of the lift cylinders 136. The length of the left and right lift cylinders 136 determines how low the draft frame 126 hangs below the main frame 122. For example, the draft frame 126 may be at a lowest position below the main frame 122 (i.e., farthest from the main frame 122) when the left and right lift cylinders 136 are fully extended to their greatest length.

A circle side-shift cylinder 138 is connected to the saddle 134 and the draft frame 126 there between to side-shift the draft frame 126 and circle frame 128, and thus the moldboard 124, relative to the main frame 122. The circle side-shift cylinder 138 is a hydraulic actuator that can sweep the draft frame 126 left and right in a back and forth direction (i.e., in a generally horizontal direction relative to the ground). In addition to sweeping the draft frame 126 horizontally left and right, the circle side-shift cylinder 138 can also rotationally sweep the draft frame 126 in the yaw direction. Specifically, when the circle side-shift cylinder 138 works in conjunction with the circle frame 128, the horizontal movement of the circle side-shift cylinder 138 combined with the rotational movement of the circle frame 128 affects the position of the draft frame 126 and moldboard 124 in the yaw direction.

A moldboard side-shift cylinder 140 is connected to the tilt frame 130 and the moldboard 124 there between. The moldboard side-shift cylinder 140 is operable to move the moldboard 124 in translation relative to the tilt frame 130 along a longitudinal axis of the moldboard 124.

It should be understood by those skilled in the art that the connection points of the above-referenced cylinders may be positioned at alternative locations on the work machine 100 within the scope of the present disclosure and are not limited to those specifically represented in FIGS. 1-3.

The embodiment of a work machine 100 as represented in FIGS. 1-3 may further include one or more position sensors 204, for example in the form of cylinder sensors 204*a* that each monitor a parameter of a corresponding cylinder 136 related to the length of that cylinder 136. For example, the work machine 100 may include cylinder sensors 204*a* on each of the left and right lift cylinders 136, respectively. The cylinder sensors 204*a* help track the position of the left and right lift cylinders 136 along the stroke path to determine the extent to which the left and right lift cylinders 136 are extended or retracted. Thus, the cylinder sensors 204*a* are used to determine the length of the left and right cylinders 136 based on the length of extension of the left and right cylinders 136. The cylinder sensors 204*a* may be linear position sensors, encoders, or various other types of position sensors 204 as are known in the art and configured to indicate the position of the left and right lift cylinders 136 such that the length thereof can be determined, such as for example generating signals representing a location along the axis of the cylinder 136. The first and second sensors 204*a* may be used to determine a change in cylinder length, for example, by identifying a change in location along the axis of the cylinder 136, or may be used to determine a change in cylinder length by measuring the amount of hydraulic fluid that is pumped through the cylinder 136.

In certain embodiments (not shown), the work machine 100 may include an additional or alternative position sensor 204 located on the circle side-shift cylinder 138. The circle side-shift cylinder sensor may track the position of the circle side-shift cylinder 138 along the stroke path to determine the extent to which the left and right lift cylinders 136 are extended or retracted, and thus, the length of the circle side-shift cylinder 138.

In certain embodiments (not shown), the work machine 100 may include an additional or alternative position sensor 204 on the circle frame 128. The circle frame sensor may be used to determine the degree to which the circle frame 128 is rotated about a central axis, and may for example be a rotary sensor, magnetic sensor, angular encoder, or another type of position sensor 204 capable of determining the degree of rotation of the circle frame 128.

As shown in FIGS. 1 and 2, in some embodiments the work machine 100 may include one or more additional or alternative position sensors 204*b*, 204*c* located on the main frame 122, such as for example inertial measurement units (IMU's) that capture a variety of motion- and position-based measurements, including, but not limited to, velocity, acceleration, angular velocity, and angular acceleration. Sensor 204*b* may for example be an inertial sensor or other type of sensor capable of sensing the roll and/or pitch of the main frame 122. Sensor 204*c* may for example be an inertial sensor capable of identifying relative movement between the sensor 204*c* and another sensor such as sensor 204*b*.

IMUs may include a number of sensors having respective sense elements and including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similarly to that of the magnetometer, the gyroscope yields information on a positional, or angular, orientation of the IMU. Accordingly, the magnetometer may be used in lieu of the gyroscope, or in combination with the gyroscope, and complementary to the accelerometer, in order to produce local information and coordinates on the position, motion, and orientation of the IMU.

In certain embodiments, a position sensor 204 for monitoring and/or identifying a position of the work implement 124 relative to the main frame 122 may include an imaging device such as for example a camera having at least a portion of the work implement 124 within its field of view.

In certain embodiments, position sensors 204 for monitoring and/or identifying a position of the work implement 124 in a local reference frame/system may include radio frequency (RF) devices mounted in respective locations such that the signals received therefrom are indicative of three dimensional changes in position using for example time of flight (i.e., time of arrival) calculations.

As will be understood by a person of ordinary skill in the art, the aforementioned position sensors 204 may be a variety of different sensors known in the art that are capable of performing the functions described herein. Additionally, it should be understood that the work machine 100 may include a greater or fewer number of position sensors 204, or a different combination of position sensors 204 than those discussed above. For example, in some embodiments, the work machine 100 may include multiple position sensors 204 in place of one of the sensors 204 discussed above. In other embodiments, one or more of the position sensors 204 may be excluded from the work machine 100. The representative functionality of one or more sensors 204 may be replaced by machine logic or other control systems to identify a parameter that would otherwise be measured by a discrete position sensor 204 described herein.

As represented in FIG. 3, a work machine 100 as disclosed herein may further include one or more sensors 202 having an external field of view 300 with respect to the work machine 100. An external field of view 300 as described herein may include portions of the work machine 100 within the field of view 300, as is represented in FIG. 3 itself, but the location represented in FIG. 3 is merely illustrative and the one or more sensors 202 may desirably be configured and oriented in any number of additional or alternative locations such that representative features of the terrain or otherwise associated with the terrain being worked are captured within the field of view 300 and identifiable from signals generated by the sensors 202. Exemplary such sensors 202 may include stereo cameras. In the alternative or in addition, a surface scanning system having an external field of view 300 may include one or more of an infrared camera, a video camera, a PMD camera, high resolution light detection and ranging (LiDAR) scanners, radar detectors, laser scanners, and the like, along with appropriate data processing such as for example implementing fusion algorithms where sensors of different types may be combined to improve accuracy or functionality independent of working conditions, etc. The number and orientation of such devices 202 in a surface scanning system may vary in accordance with the type of work machine 100 and relevant applications, but may at least be provided with respect to areas forward and/or rearward of the work machine 100 and accordingly configured to capture data associated with relevant surroundings proximate the work machine 100.

The position and size of an image region recorded by a respective external field of view sensor 202 such as a stereo camera in embodiments as disclosed herein may depend on the arrangement and orientation of the camera and the camera lens system, in particular the focal length of the lens of the camera. One of skill in the art may further appreciate that image data processing functions may be performed discretely at a given image data source if properly configured, but also or otherwise may generally include at least some image data processing by the controller or other downstream data processor. For example, image data from any one or more surface scanning data sources may be provided for three-dimensional point cloud generation, image segmentation, object delineation and classification, and the like, using image data processing tools as are known in the art in combination with the objectives disclosed.

Figure 4:
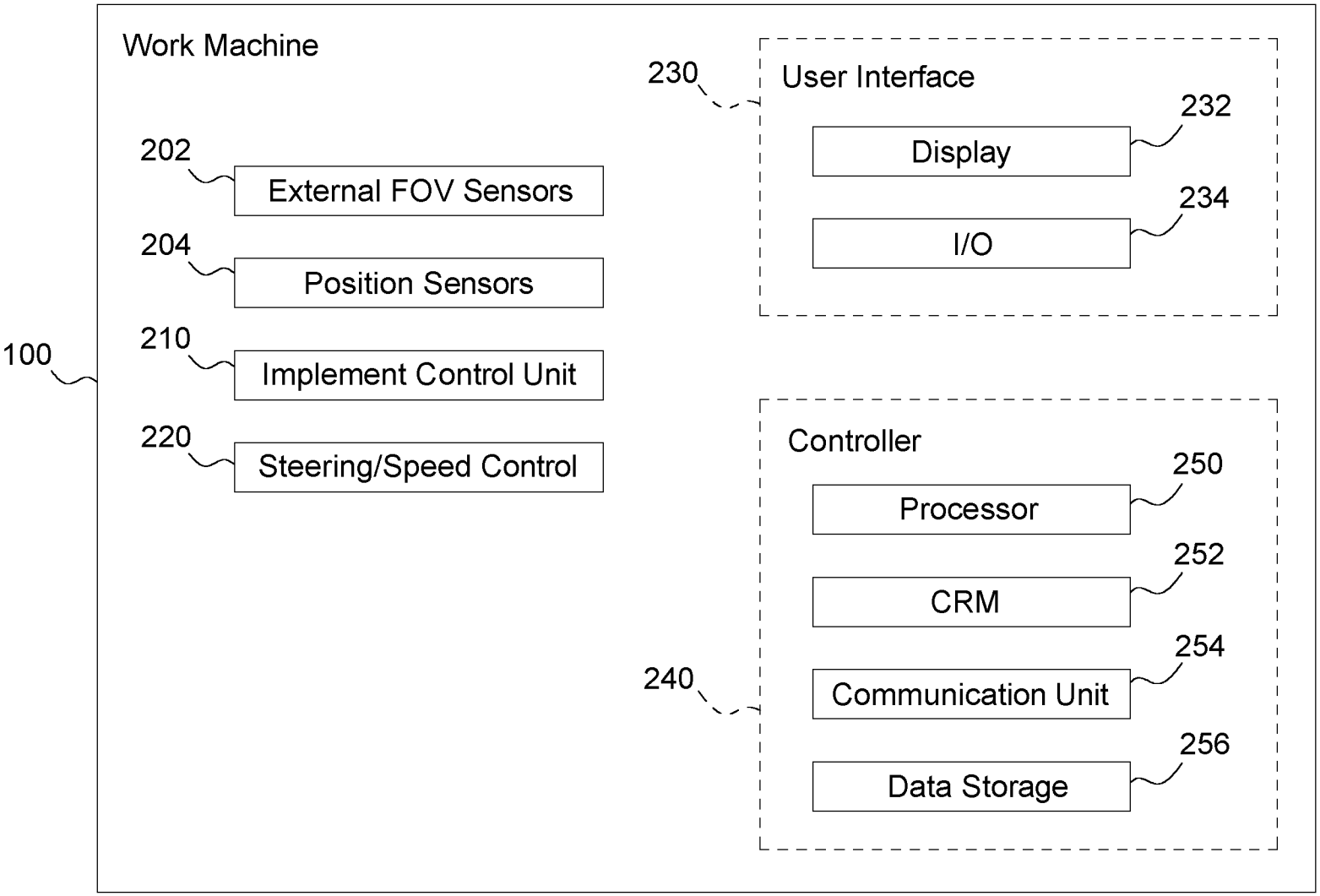
FIG. 4 is a block diagram representing an exemplary control system according to an embodiment as disclosed herein.

Referring next to FIG. 4, a control system is provided in association with the work machine 100, wherein multiple inputs are provided to a controller 240 for, e.g., generating output signals for displaying relevant work implement position information, regulating control of one or more operations of the work machine 100, and the like.

External point of view sensors 202 and position sensors 204 as previously described herein may generate signals to the controller 240. For example, one or more inertial measurement units (IMU's) 204*b*, 204*c* may be arranged on respective components of the work machine 100 and configured to generate outputs (e.g., respective three-axis acceleration and gyroscopic output signals) to the controller 240, alongside or as an alternative to cylinder sensors 204*a* integrated within respective hydraulic cylinders, such as for example the tilt cylinder 132, left and right blade-lift cylinders 136, and side-shift cylinders 138, 140 as previously described for positioning of the moldboard 124, and configured to generate output signals to the controller 240 representative of cylinder extension and accordingly the blade angle and the blade position, respectively.

The controller 240 may be part of the machine control system of the working machine 100, or it may be a separate control module. Accordingly, the controller 240 may generate control signals for controlling the operation of various actuators throughout the work machine 100, which may for example include or be integrated within an implement control unit 210 and/or a travel (i.e., steering, ground speed) control unit for controlling the respective operations. Electronic control signals from the controller 240 may for example be received by electro-hydraulic control valves associated with respective actuators, wherein the electro-hydraulic control valves control the flow of hydraulic fluid to and from the respective hydraulic actuators to control the actuation thereof in response to the control signal from the controller 240. The controller 240 may include or be functionally linked to the user interface 230, for example to generate text, data and/or other indicia for display on an associated display unit 232, and/or to receive user inputs 234 from the user interface 230, and the controller 240 may optionally be mounted in the operator's station 120 at a control panel. As an illustrative example of user inputs 234 received by the controller 240 from the user interface 230, the user interface 230 may enable selective enabling and/or disabling by the operator of automatic control modes as described herein, or otherwise stated the operator may be able to selectively switch operating modes between a manual operating mode and any of one or more automatic operating modes depending on the operating conditions and/or practical applications of the work machine 100.

The controller 240 may be configured to receive input signals from various additional sensors associated with the work machine 100, including for example vehicle speed sensors, wheel tilt angle sensors, and the like, and whereas one or more of these sensors may be discrete in nature the controller 240 may receive associated signals provided from the machine control system.

A controller 240 in an embodiment may include or may be associated with a processor 250, a computer readable medium 252, a communications unit 254, data storage 256 such as for example a database network, and the aforementioned user interface 230 or control panel having a display 232. An input/output device 234, such as a keyboard, joystick or other user interface tool, may be provided so that the human operator may input instructions to the controller 240. It is understood that the controller described herein may be a single controller having all of the described functionality, or it may include multiple controllers wherein the described functionality is distributed among the multiple controllers.

Various operations, steps or algorithms as described herein can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium 252 known in the art. An exemplary computer-readable medium 252 can be coupled to the processor 250 such that the processor 250 can read information from, and write information to, the memory/storage medium. In the alternative, the medium 252 can be integral to the processor 250. The processor 250 and the medium 252 can reside in an application specific integrated circuit (ASIC). The ASIC can reside in a user terminal. In the alternative, the processor 250 and the medium 252 can reside as discrete components in a user terminal.

The term "processor" 250 as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

A communications unit 254 may support or provide communications between the controller 240 and external systems or devices, and/or support or provide a communication interface with respect to the sensing elements and other internal components of the work machine 100. The communications unit 254 may include wireless communication system components (e.g., via cellular modem, WiFi, Bluetooth or the like) and/or may include one or more wired communications terminals such as universal serial bus ports.

Figure 5:
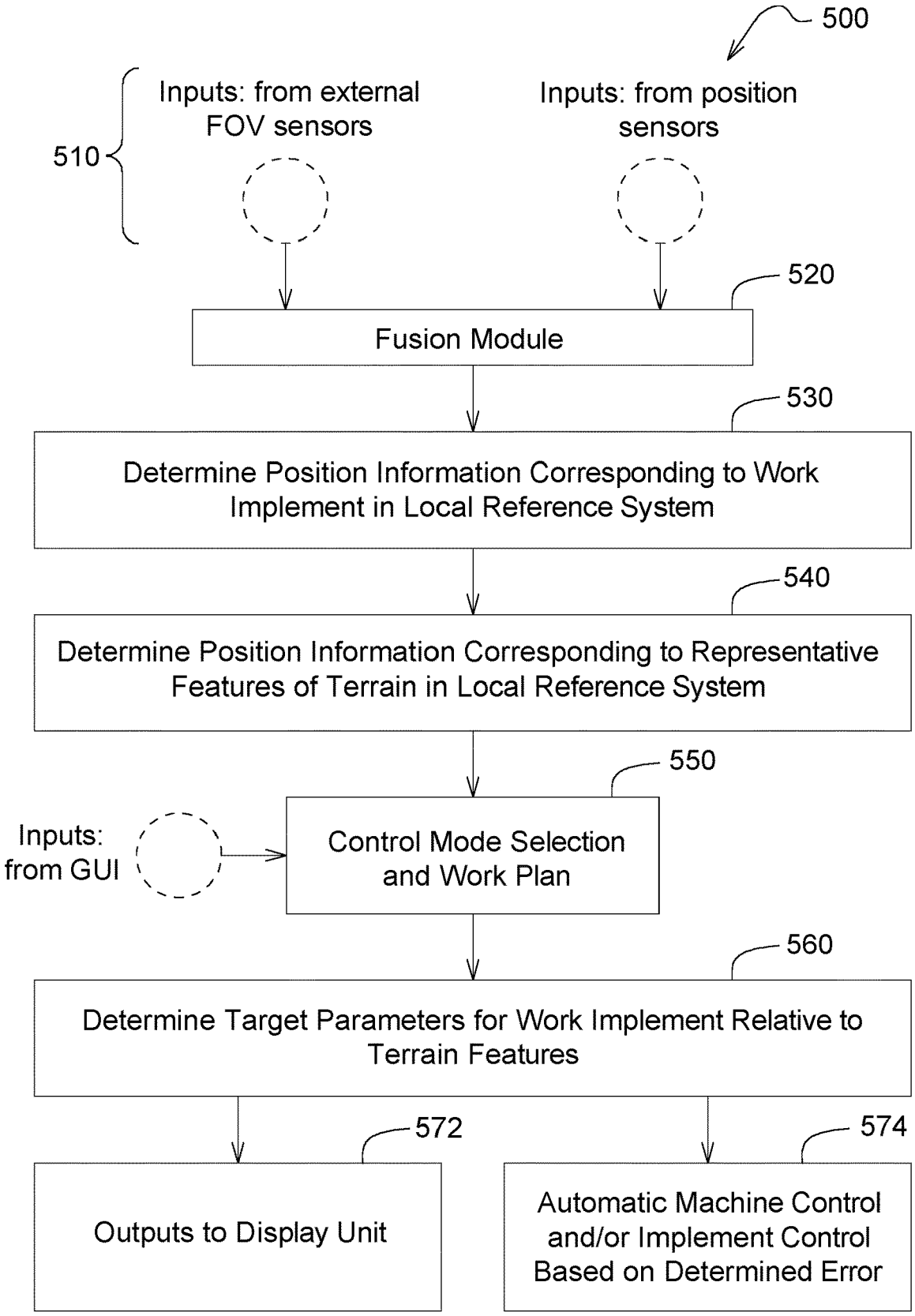
FIG. 5 is a flowchart representing an exemplary method according to an embodiment as disclosed herein.

An exemplary embodiment of a method 500 may next be described, with illustrative reference to FIG. 5. While the method 500 may be described with illustrative reference to a motor grader as shown in FIGS. 1 to 3, it should be understood that various embodiments of the method 500 may be applied with respect to alternative work machines 100 within the scope of the present disclosure, including but not limited to excavators, bulldozers, road milling machines, paving machines, and the like.

In the illustrative embodiment, in step 510 signals are received from one or more onboard position sensors (e.g., cylinder sensors) and from one or more external field of view sensors (e.g., stereo cameras). The received signals may be processed for determining, in the same local reference system independent of a global reference system, position information corresponding to the work implement (step 530) and position information corresponding to one or more representative features of the terrain in the external field of view (step 540). In an embodiment a fusion module associated with the controller may be implemented to effectively map sense elements from the disparate types and locations of sensors into a local reference system associated with for example the work machine and independently of a global coordinate reference. For example, an origin of the local reference system may be associated with the work machine 100 and a relative position and/or orientation of objects such as the work implement and external features of the terrain may be determined in a common work machine reference frame, as each of the sensors are fixed to the work machine.

Representative features of the terrain may be captured for example via surface scans in a field of view comprising at least part of a forward work area. The term "forward work area" or equivalents as used herein may refer for example to at least a portion of the work area generally in front of the work machine 100 when the work machine is travelling in a forward direction. As previously noted, the scanned data may be provided via an image data source (e.g., stereo camera), optical sensor, radar sensor, etc. The scanned data as collected in the field of view including a forward portion of the work area may include for example images, point clouds, or the like representing curbs, surface profiles, obstacles, or other relevant aspects of the terrain or otherwise proximate a portion of the terrain being worked.

In various embodiments, the scanned data may be analyzed to detect a profile and/or contours of the terrain and/or features associated with the terrain, using for example three-dimensional point cloud generation, image segmentation, object delineation and classification, and the like, using image data processing tools as are known in the art, further optionally in view of confirmation inputs which may be provided via for example a selected work plan to assist in image processing and recognition. A relative distance between components of the work machine and features in the terrain may be determinable based for example on a size, orientation, and/or shape of the relevant features in a captured image.

In one example, user input may be provided via a user interface in response to system-initiated prompts to confirm one or more elements of a captured image, or to proactively identify one or more elements of the captured image as a relevant feature of the terrain. In another example, a radio frequency identification (RFID) system including a plurality of devices located on the work machine 100 or at least one such device on the work machine 100 in communication with an external device may provide signals corresponding to relative distances between two respective points and thereby also provide confirmation inputs for the image processing system as needed.

Contemplated image processing techniques within the scope of the present disclosure may further utilize a stored reference profile corresponding to predetermined contours of features of the terrain. The reference profile may be predetermined and retrieved from data storage upon identifying the particular feature or type of feature, or may be input directly from the user interface, or may be developed over time in the context of an image recognition model using machine learning techniques, etc.

According to a selected control mode and/or predetermined work plan, details for which may for example be provided manually from an operator via an onboard user interface, retrieved from data storage, and/or may be automatically provided based on for example current work conditions or other machine parameters (step 550), at least one target parameter for the work implement may be determined based on the position information corresponding to the one or more representative features (step 560). A target profile including predetermined grade, cross-slope, or the like may for example be provided by a site planning or work planning file or program which indicates a target topography of the area in which the transport vehicle 100 is operating. The retrieved information may include further information regarding a curb, crown, or other terrain features that may be identifiable using the external field of view sensors and wherein target parameters may be established corresponding to a requisite distance between the work implement and said terrain feature, while further maintaining the specified grade, cross-slope, milling depth, etc. In various embodiments, a site plan may include a topographic map be created at the time a road was built by recording points along the surface of the road as it was produced, or having a surveying crew or vehicle later measure and record such points, and then utilizing these points with software that can take them and create a topographic map of the road.

In some embodiments, a target position of the work implement may be determined at least in part based on a determined position of the work implement relative to the local (i.e., machine) reference system and one or more aspects of a work plan, which for example may further relate to the relative positions of observed features of the terrain. A difference (i.e., a positioning error) between the target position and the determined (i.e., actual) position of the implement relative to the local reference system may then be determined, wherein the controller automatically controls (or directs control of) the position of the work implement using relevant work implement control units and associated actuators in the work machine (step 574). In another example, the controller may generate an indication when the difference is greater than a threshold, such as for example transmitting a signal to the user interface that generates a notification for the operator of the work machine (step 572). The notification may alert the operator that the work implement is out of a predetermined range, which may be adjusted by setting different values for the threshold. The operator may then manually reposition the work implement.

Controlled movement of the work machine may include for example control signals for actuation of elements associated with an advance speed (e.g., drivetrain), steering of ground engaging units, and/or orientation of the main frame. Controlled position of the work implement may include for example extending, lifting/lowering, pivoting, and/or rotating the work implement, among other possibilities depending on the type of work machine and/or work implement.

One of skill in the art may appreciate that, depending for example on a resolution of the various sensors and/or capabilities of the data processing with respect to the terrain features at issue, movement of the work machine and/or the position of the work implement may preferably be controlled further in view of a margin of safety between at least one ground engaging tool of the work implement and the at least one target parameter.

In addition, or in the alternative, the output signals may be provided for displaying information corresponding to a position of the work implement on a display unit onboard the work machine and/or a display unit associated with a mobile computing device. The delivery of display signals, the particular format and/or subject matter of the displayed information, and/or the destination devices for display of the information may be selectable by the operator or other authorized user.

In one example of the above-referenced functions, a motor grader may be configured to follow a set elevation according to a predetermined site plan and/or relative to an established roadside feature such as a curb, string line, etc., while implementing multidimensional grade control to maintain a specified grade (e.g., a slope along at least one direction) of ground of a work site. As the work machine 100 is moved along the work site, the moldboard (or blade) is positioned and rotated appropriately to shape and/or re-shape the ground (e.g., grade the ground), based on the determined exact position of the work implement in the local reference (e.g., machine coordinate) system and on the determined exact position of the external reference feature (s) in the same local reference system. Because grading the ground may be vital to construction, it may be necessary to control the blade within a few millimeters (e.g., to at least within 30 millimeters) in some applications. Embodiments of a system and method as disclosed herein may desirably prevent potential damage to curbs and associated rework and may potentially improve subgrade/base accuracy to reduce material overages over time through increased precision.

As another example but in substantially the same context, a compact track loader, skid steer loader, or the like may be configured for multidimensional grade control, using a work implement assembly (boom assembly) including a bucket as a working tool and one or more intervening components between the bucket and the main frame.

In another example, a cold planer may be similarly configured but to implement control for maintaining a specified milling depth or cross-slope in the working area proximate to the roadside feature.

In another example wherein a system and method as disclosed herein may be implemented for paving machines, such a system may desirably eliminate the need for expensive multiplex skis, providing further benefits over various conventional systems.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method for operating a work machine having a main frame supported by one or more ground engaging units, wherein the work machine travels in a working direction and at a ground speed based at least in part on control of the ground engaging units, wherein the work machine comprises a work implement supported from the main frame and configured for working at least part of a terrain across which the work machine travels, the method comprising:

determining in a local reference system independent of a global reference system, via signals received from one or more first sensors located with respect to each of the work implement and the main frame of the work machine, position information corresponding to the work implement;

determining in the local reference system, via signals received from one or more second sensors having a field of view associated at least in part with the working direction, position information corresponding to one or more representative features of the terrain to be worked and an external reference feature separate from the terrain to be worked;

during at least an automatic control mode, determining at least one target parameter for the work implement based on the position information corresponding to the one or more representative features based on user input and/or a predetermined work plan; and generating output signals corresponding to a difference between the position information corresponding to the work implement and the at least one target parameter, wherein the output signals are provided for automatically controlling movement of the work machine and/or a position of the work implement, for working the terrain based on the at least one target parameter and relative to the external reference feature.

2. The method of claim 1, wherein the at least one target parameter is selected from a group consisting of: a target elevation; a target depth; a target slope; a target grade or profile; and a target route or trajectory.

3. The method of claim 1, wherein the output signals are provided for displaying information corresponding to a position of the work implement on a display unit onboard the work machine and/or a display unit associated with a mobile computing device.

4. The method of claim 1, comprising fusing sense elements of the received signals from a plurality of the first sensors in the local reference system.

5. The method of claim 4, wherein at least one of the first sensors is located on the main frame and at least one of the first sensors is located in association with a position of the work implement relative to the main frame.

6. The method of claim 4, wherein different ones of the plurality of first sensors are located on respective components of the work implement between the main frame and a ground engaging tool.

7. A work machine comprising:

a main frame supported by one or more ground engaging units, wherein the work machine travels in a working direction and at a ground speed based at least in part on control of the ground engaging units;

a work implement supported from the main frame and configured for working at least part of a terrain across which the work machine travels;

one or more first sensors configured to generate signals corresponding to positions of the work implement;

one or more second sensors having a field of view associated at least in part with the working direction and configured to generate signals corresponding to positions of one or more representative features of the terrain in the field of view; and a controller functionally linked to the one or more first sensors, the one or more second sensors, and at least one actuator associated with controlled movement of the work implement relative to the terrain, the controller configured to:

determine in a local reference system independent of a global reference system, via signals received from the one or more first sensors located with respect to each of the work implement and the main frame of the work machine, position information corresponding to the work implement;

determine in the local reference system, via signals received from the one or more second sensors, position information corresponding to the one or more representative features of the terrain to be worked and an external reference feature separate from the terrain to be worked;

during at least an automatic control mode, determine at least one target parameter for the work implement based on the position information corresponding to the one or more representative features based on user input and/or a predetermined work plan; and generate output signals corresponding to a difference between the position information corresponding to the work implement and the at least one target parameter, wherein the output signals are provided for automatically controlling movement of the work machine and/or a position of the work implement, for working the terrain based on the at least one target parameter and relative to the external reference feature.

8. The work machine of claim 7, wherein the at least one target parameter is selected from a group consisting of: a target elevation; a target depth; a target slope; a target grade or profile; and a target route or trajectory.

9. The work machine of claim 7, wherein the output signals are provided for displaying information corresponding to a position of the work implement on a display unit onboard the work machine and/or a display unit associated with a mobile computing device.

10. The work machine of claim 7, wherein the controller is configured to fuse sense elements of the received signals from a plurality of the first sensors in the local reference system, wherein at least one of the first sensors is located on the main frame and at least one of the first sensors is located in association with a position of the work implement relative to the main frame.

11. The work machine of claim 10, wherein the at least one of the first sensors located in association with a position of the work implement relative to the main frame comprises a plurality of sensors located in association with respective hydraulic piston-cylinder units for positioning of the work implement relative to the main frame.

12. The work machine of claim 10, wherein the at least one of the first sensors located in association with a position of the work implement relative to the main frame comprises at least one sensor having a field of view comprising at least a portion of the work implement.

13. The work machine of claim 10, wherein the at least one of the first sensors located in association with a position of the work implement relative to the main frame comprises a least one radio frequency transmitter.

14. The work machine of claim 7, wherein the controller is configured to fuse sense elements of the received signals from a plurality of the first sensors in the local reference system, wherein at least one of the first sensors is located on the main frame and at least one of the first sensors is located in association with a position of the work implement relative to the terrain.

15. The work machine of claim 14, wherein the at least one of the first sensors located in association with a position of the work implement relative to the terrain comprises a plurality of sensors located in association with respective hydraulic piston-cylinder units for positioning of the work implement relative to a ground surface.

16. The work machine of claim 7, wherein the controller is configured to fuse sense elements of the received signals from a plurality of the first sensors in the local reference system, wherein different ones of the plurality of first sensors are located on respective components of the work implement between the main frame and a ground engaging tool.

17. The method of claim 1, wherein the one or more sensors comprise one or more sensors associated with cylinders actuating the work implement relative to the main frame, and one or more IMUs mounted on the main frame.

18. The work machine of claim 7, wherein the one or more sensors comprise one or more sensors associated with cylinders actuating the work implement relative to the main frame, and one or more IMUs mounted on the main frame.

* * * * *